United States Patent [19]

Wirz

[11] 4,193,700

[45] Mar. 18, 1980

[54] CONTINUOUS-FLOW MIXER FOR THE GLUING OF LOOSE CHIPS OF WOOD, FIBERS, OR OTHER PARTICLES

[75] Inventor: Walter Wirz, Thalwil, Switzerland

[73] Assignee: Peter Fahrni, Kilchberg, Switzerland

[21] Appl. No.: 527

[22] Filed: Jan. 2, 1979

[51] Int. Cl.[2] ..... B01F 9/06; B01F 15/02

[52] U.S. Cl. ..... 366/156; 366/170; 366/175; 118/418

[58] Field of Search ..... 366/228, 225, 227, 220, 366/232, 156, 157, 169, 170, 173, 174, 175, 180; 118/418

[56] References Cited

U.S. PATENT DOCUMENTS

| | | | |
|---|---|---|---|
| 3,623,737 | 12/1952 | McEachran | 366/175 |
| 2,761,420 | 9/1956 | Mottet | 366/228 |
| 3,277,540 | 10/1966 | Buhrer | 366/232 |
| 3,368,278 | 2/1968 | Opie | 366/227 |
| 3,471,267 | 10/1969 | Capes | 366/232 |
| 3,796,412 | 3/1974 | Maurer | 366/220 |
| 3,802,822 | 4/1974 | Harbison | 366/157 |
| 4,057,225 | 11/1977 | Ferree | 366/157 |
| 4,068,831 | 1/1978 | Ebeling | 366/156 |

*Primary Examiner*—Robert W. Jenkins

*Attorney, Agent, or Firm*—Anthony J. Casella; Michael A. Stallman

[57] ABSTRACT

A continuous-flow mixer for applying glue to wood particles used in making particleboard panels includes a rotating drum inclined at an angle to the horizontal and having at one end a glue spray nozzle aligned with the axis of rotation of the drum. Outlet openings are provided at the opposite ends of the drums such that the treated particles are conveyed by rotation of the drum and emerge unimpeded out of the drum via the outlet openings, and trickle onto a conveyor for removal of the treated particles.

8 Claims, 3 Drawing Figures

CONTINUOUS-FLOW MIXER FOR THE GLUING OF LOOSE CHIPS OF WOOD, FIBERS, OR OTHER PARTICLES

The object of the present invention is a continuous-flow mixer for the gluing of loose chips of wood, fibers, or other particles which are intended for the manufacture of pressed bodies, the mixer having a drum which is supported for rotation around an axis which is oblique to the horizontal with drivers, arranged on the inside of the wall of the drum for conveying the particles into the upper part of the inside of the drum and stewing them into said space, means coupled with the drum for the rotary driving of the drum, means for supplying the particles to be treated to the higher inlet side of the drum, at least one pressure nozzle acting substantially in the direction of the axis of rotation of the drum or parallel thereto for spraying binder into the inside of the drum, and furthermore means for removing the treated particles in the region of the lower outlet side of the drum.

From U.S. Pat. No. 2,761,420 there is known a mixer of this type which serves, in particular, for coating small fibrous particles of wood with a synthetic-resin binder. After treatment in the mixer, these particles are strewn onto flat supporting surfaces and thereupon compressed to form a fiberboards by the application of heat and pressure, For a favorable arrangement of the pressure nozzle, as well as a suitable inclination and speed of rotation of the drum, the previously proposed principle assures an excellent, uniform distribution of the binder over the particles and thus permits the production of high-grade final products having very good physical properties. One considerable advantage is also the relatively small consumption of binder. These results are due to the fact that the drivers, which are arranged within the drum parallel to the longitudinal axis of the latter, due to the rotation of the drum lift the material and convey it upward so that it gradually slides down from the drivers and, distributed in the manner of snowflakes, passes through the inside of the drum, which is traversed by the jet of binder until it again falls between drivers in the lowermost space of the drum and is again brought into the region of the drum which lies above the axis of rotation. In the course of several such alternate processes of conveyance and free fall, the particles-considered statistically—gradually arrive at the point of removal of the particles. The average time of stay of the particles in the mixing drum depends, inter alia, on the inclination of the axis of rotation of the drum with respect to the horizontal. The smaller the angle between the axis of rotation of the drum and the horizontal, the longer the average time of stay of the particles in the drum will be.

In the machine proposed in the aforementioned U.S. patent, the drum is provided with a plurality of revolving steel rails of strong construction which, in their turn, rest on, in part, driven rollers of a frame and thus permit a rotation of the drum. The lower end of the drum is substantially closed by an immovable header which does not form an actual part of the drum itself. This header is cut out in segment shape at its lower part so that the glued particles can gradually emerge from the drum and then be conveyed further.

Despite the basic advantages of this mixer, which was suggested more than 20 years ago, it has, however, not yet been used in practice since it has been found that the machine is bulky and very heavy, due to the accuracy and mechanical stability required for the proper establishing of the roller drive, and is furthermore complicated and accordingly expensive. In addition, a larger amount of energy is lost in the driving of the drum, which lies on the rollers. Finally, problems arise in connection with the removal of the treated particles, since they accumulate on the header opening and cannot be easily removed.

These drawbacks are regrettable since particularly in case of the problem of the uniform binder-saving gluing of chips which are to be worked into particle boards, it appears very desirable to utilize the principle of mixing described in the said patent as well as other literature references.

The technological object which forms the basis of the invention resides in creating a continuous-flow mixer which, while it has the advantages of the previously known construction, does not have the disadvantages thereof. The object of the invention is to provide a simple, compact, trouble-free mixer the operation of which requires little energy and in which the removal of the glued particles takes place readily and without accumulation at the discharge end. This object can be achieved in accordance with the present invention, by the features contained in the body of claim 1.

Two embodiments of a continuous-flow mixer in accordance with the invention are shown in the drawing, in which.

Figure 1:
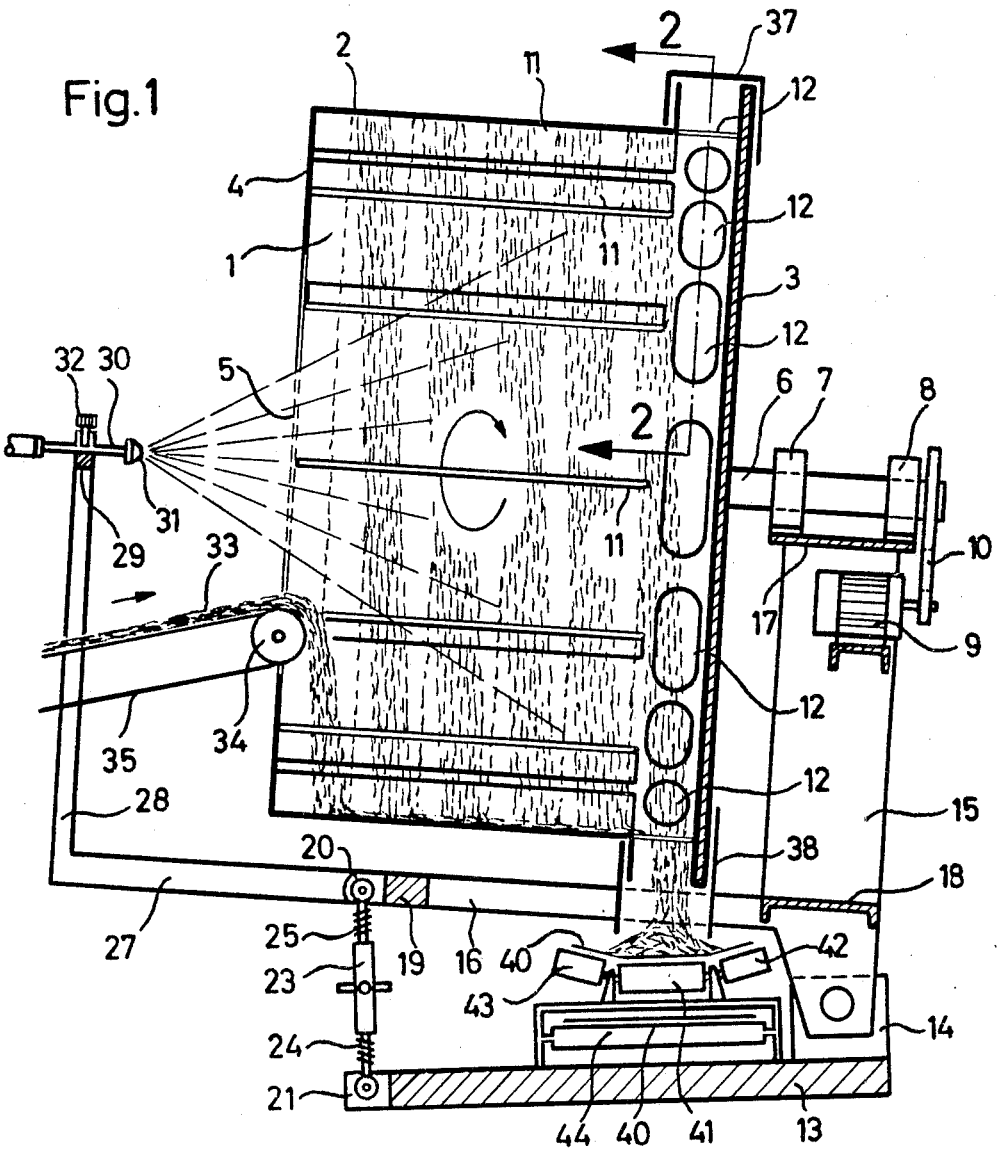
FIG. 1 shows a first embodiment of the mixer in longitudinal section, the vertical sectional plane being so selected that the axis of rotation of the drum lies in it.
Figure 2:
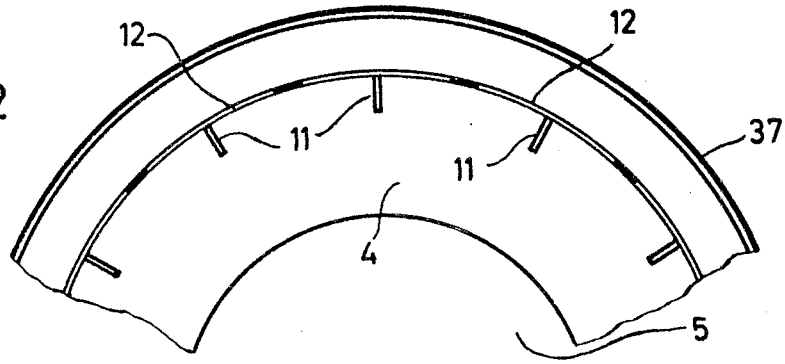
FIG. 2 is a partial view of the drum in section along the line 2—2 of FIG. 1.

The main element of the gluing machine shown in FIGS. 1 and 2 is the so-called gluing drum 1, consisting of a drum shell 2 and a drum header 3 rigidly connected with the latter. On its inlet side, the drum is partially closed in such a manner as to leave free a central opening 5 which is surrounded by a ring 4. In the center of the header 3 there is firmly attached a rotation shaft 6 which is held by two supports 7 and 8. This shaft can be placed in rotation by a toothed-belt drive 10, via a motor 9. The drivers 11, arranged on the inside of the drum shell 2 parallel to the axis of the drum, can be particularly easily noted in FIG. 2. The purpose of these drivers is to convey the particles upward in known manner during the rotation of the drum, whereupon the particles gradually slip off and trickle down into the lower part of the drum in a fine veil-like stream. The outlet openings provided at the outlet of the drum, in the shell thereof, and in the peripheral vicinity of the header 3 are designated 12. The function of these openings is fully explained further below.

The drum 1 is held by a supporting frame which consists essentially of a base plate 13, two supports 15 which are swingably supported on vertical plates 14 and are parallel to each other, and a frame 16 which forms a unit with the supports 15. The entire construction is symmetrical with respect to the vertical longitudinal central plane of the drum. For this reason, only the rear parts 15 and 16 as well as the transverse struts 17, 18 and 19 which are shown in cross section, are visible in the drawing. From the center of the transverse beam 19 and from the center of the base plate 13 there extend in each case two brackets 20 and 21 respectively, on which two oppositely threaded spindles 24 and 25 which form part of a manually actuatable turnbuckle 23 are mounted. This turnbuckle permits a simple adjustment of the inclination of the frame construction 16, 18 and 19, and thus an adjustment of the inclination of the axis of the drum with respect to the horizontal.

The part of the frame construction which is parallel to the axis of rotation of the drum is supplemented by two beams, one of said beams 27 being shown in the drawing. At the ends of these beams there are provided arms 28 which extend perpendicularly from them and which in their turn are supplemented by a transverse strut 29 to form a stable yoke. In the center of the transverse strut 29 there is seated the binder supply pipe 30, whose end is closed by a pressure nozzle 31 for the atomizing of the binder. It can furthermore be seen that this pressure nozzle lies outside the drum. It is thus easily accessible and, after the loosening of a fastening screw 32, can be adjusted in position. This adjustability permits adaptation to the specific requirements (nature and quantity of the particles, spraying pressure, viscosity of the binder, nozzle spray angle, etc.).

The particles 33 which are to be glued are conducted into the drum 1 by a conveyor belt 33 which moves over a roller 34. It is essential here that the particles enter into the drum before they are subjected to any substantial extent to the action of the jet of binder. On the other hand, the type of conveyance shown has the advantage that drops of binder which drip down upon the connecting and disconnecting of the binder spray jet automatically come onto the particles 33 which have been transported below the nozzle 31.

In order to assure dependable removal of the glued particles without contamination of the air, the outlet side of the drum is covered over a substantial part of its periphery by a firmly attached collecting channel 37 which is open towards the outlet openings 12 and covers the latter towards the outside. At the lowermost end of the drum, the collecting channel 37 discharges into a particle discharge shaft 38, which feeds the glue-coated particles to a conveyor belt 40, which moves on rollers 41, 42, 43 and 44.

This machine, whose construction has just been described, operates in the following manner:

First of all, the still unglued particles are supplied in a continuous stream 33 to the rotating drum 1. The drivers 11 take up said material, convey it to the upper part of the drum, and let it fall down in the manner of snowflakes into the inside of the drum. If the speed of rotation of the drum and of the drivers 11 is properly determined, the formation of a uniform veil can be obtained. After the first passage, the particles are raised again and thus contribute several times to the formation of the veil before they pass into the vicinity of the outlet openings 12. During these passages, the average number of which depends on the angle of inclination of the axis of rotation of the drum, the particles are subjected to the spray jet of the nozzle 31 which extends in the direction towards the header 3 of the drum. This multiple circulation of the particles and the formation of veils of particles result in extremely favorable conditions for a uniform and complete gluing of the individual particles, resulting in excellent properties on the part of the pressed bodies made from the particles.

The fact is also important that in the region of the header 3 of the drum the particles can be removed from the drum without additional expense and without additional equipment. In fact, the particles, as a result of the inclination of the angle of rotation of the drum, fall sooner or later, so to speak, positively through an outlet opening so that undesired accumulations need not be feared.

Within the inventive concept, the continuous-flow mixer can be perfected in various ways or supplemented by additional means. Thus, for instance, the rotation shaft 6 can be made hollow and a pipe, provided with a nozzle can be extended through it to serve to spray impregnating emulsions or other sprayable agents. Furthermore, it would be possible, by means of simple elements, to produce a slight stream of air from the inlet side to the outlet side of the drum so that the small particles are subjected for only a shorter period of time to the jet of binder and in this way an overgluing of the fine material is prevented.

Should it turn out that, despite the coating of the inside of the drum with teflon, particles should stick to the driverss 11 or to other points in the case of certain types of glue, it is advisable to provide special cleaning elements or the like. Thus, for instance, compressed-air nozzles could be provided at a suitable place within the drum. There can also be provided movable mechanical cleaning members, such as brushes, scrapers or the like. Dirtying of the inside of the drum could be prevented by a slow relative rotation between the drum shell 2 and the drivers 11.

In addition to the advantages indicated above, it will also be noted that the construction can be extremely light. It is in no way critical with respect to precision of the working and, if for only this reason, is not subject to trouble.

Figure 3:
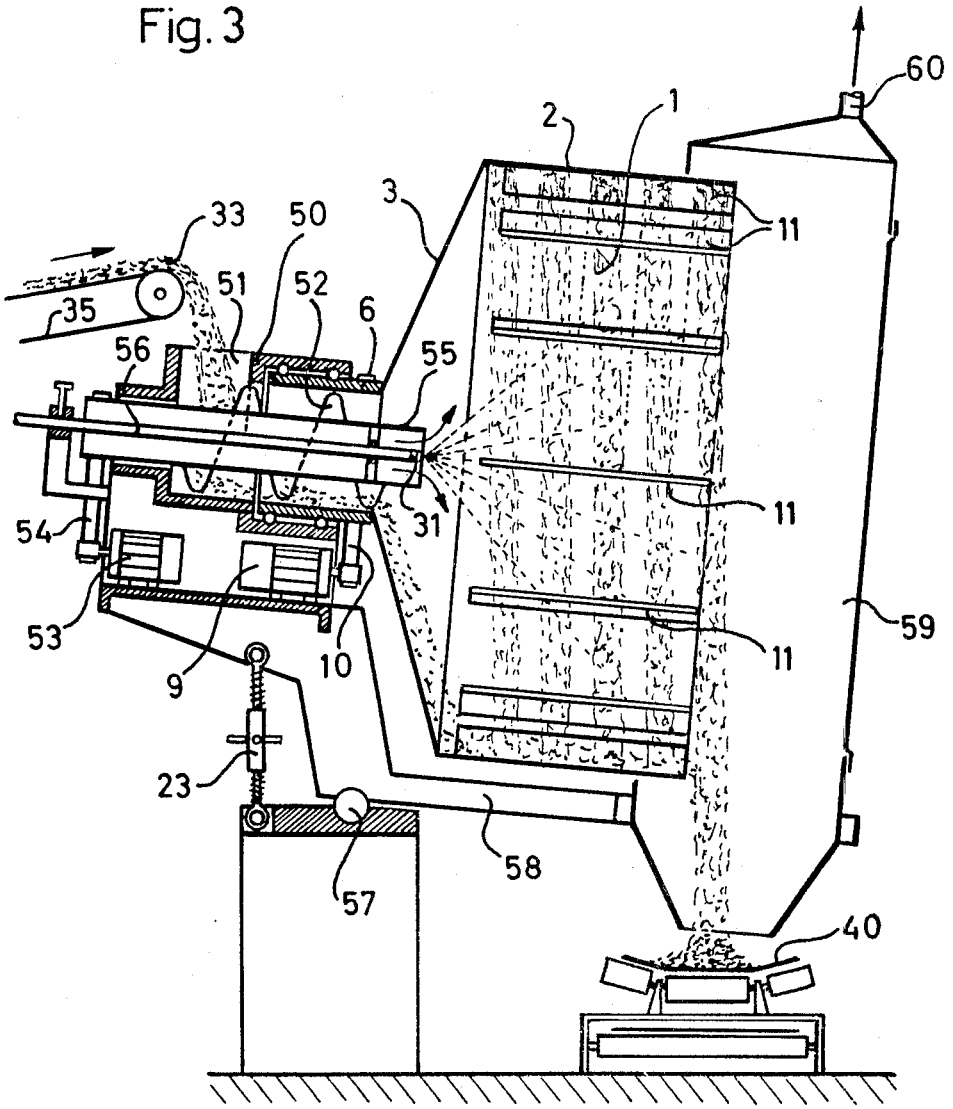
FIG. 3 is a longitudinal section through a second embodiment of the mixer.

The machine shown in FIG. 3 also has considerable advantages. In the showing of FIG. 3 the same reference numbers have been used as in FIGS. 1 and 2, insofar as analogous parts or at least components or machine parts which are comparable in their function are concerned.

The greatest difference from the first embodiment in the case of this mixer is that the drum header 3 which closes the drum 1 off on the one side and is connected with the rotation shaft 6 does not close off the removal or outlet side of the drum 1, but rather the higher-located inlet side of the drum. The hollow rotation shaft 6 is supported for rotation in a fixed supporting frame 50 and is driven by a motor 9 via a belt 10. The frame 50 has an opening 51 for the supplying of the stream 3 of untreated particles. For the conveying of these particles into the inside of the drum a conveyor worm 52 rotates within the rotating shaft 6. It extends around a pipe 55 which is placed in rotation by a motor 53 and a belt 54, and through which the immovable binder supply line 26 extends concentrically. The direction of rotation of the conveyor worm 52 is preferably opposite to the direction of rotation of the drum 1. The atomizer nozzle 31 is screwed onto the free end of the pipe 56. In a manner similar to that employed in the first embodiment, the position of the nozzle may be adjusted axially in order empirically to determine the best action.

The machine is mounted on a frame 58 which is swingably supported at 57 and thus forms a single unit. The angle of inclination of the mixer can be adjusted by means of the turnbuckle 23.

Finally, it can be noted from the drawing that the drum 1 is open on the outlet side, i.e., the shell 2 is not closed off by any header in the region in which the particles are already completely covered with glue. The particles which have been conducted upward by the drivers 11 can, at the outlet end of the drum, trickle unimpeded without accumulation onto the conveyor belt 40, due to the inclination of the drum. A fixed box 59 which is attached to the frame 58 and extends at its bottom conically in the direction towards an outlet opening prevents undesired eddying and dirtying. An air vent 60 facilitates the escape of the stream of air produced as a result of the spraying of the binder.

What is claimed is:

1. A continuous flow mixer for the gluing of loose chips of wood, fibers or other particles which are intended for the manufacture of pressed bodies comprising:

a generally cylindrical hollow drum rotatably mounted around an axis which is oblique with respect to the horizontal, said drum having an inlet end and an outlet end, said inlt end being positioned at a higher level than said outlet end, said drum further including a plurality of driver elements disposed on the inner surface of said drum, said drum further including a header connected to one end thereof;

means for rotating said drum, said means coupled to said header;

means for supplying the particles to be treated to said inlet end;

means for removal of said treated particles from said outlet end; and a pressure nozzle acting substantially in the direction of the axis of the drum for the spraying of a glue into said hollow drum, said nozzle being disposed adjacent said inlet end and above said particle supply means, whereby when said particles are fed into said rotating drum by said particle conveying means, said particles are conveyed by said driver elements to the upper portion of said drum whereat said particles fall downwardly through the interior of said drum in a veil-like cloud, said particles being sprayed by said glue from said nozzle as they fall, said treated particles progressively migrating to said outlet end preparatory to exiting the drum.

2. A continuous flow mixer as recited in claim 1 further including a means for adjusting the inclination of the axis of rotation of said drum.

3. A continuous flow mixer as recited in claim 1 wherein said pressure nozzle is disposed outside of the interior of said hollow drum.

4. A continuous flow mixer as recited in claim 1, wherein said pressure nozzle can be displaced in the direction of the axis of rotation of the drum and locked in such position.

5. A continuous flow mixer as recited in claim 1 wherein said header is connected to said outlet end of said drum, said drum further including a plurality of outlet openings disposed about the circumference of said drum adjacent said outlet end, said mixer further including an annular immobile collecting channel disposed around said header and in communication with said outlet openings, said collecting channel having an aperture at the lower end thereof for discharging particles into said particle removal means.

6. A continuous flow mixer as recited in claim 1 wherein said header is connected to said inlet side of said rum, and wherein said means for rotating said drum includes a shaft connected to said header, said shaft being hollow and adapted to receive a supply conduit for feeding the glue to said pressure nozzle.

7. A continuous flow mixer as recited in claim 6 further including a conveyor worm which is rotatably mounted inside of said hollow shaft, said worm being coupled with a drive means, said worm serving to feed the particles to be glued into the interior of said drum.

8. A continuous flow mixer as recited in claim 1 wherein said driver elements extend axially along the length of said drum.

* * * * *